United States Patent [19]

Fraleigh

[11] 4,225,253

[45] Sep. 30, 1980

[54] COMPRESSIBLE LIQUID CONTAINER AND APPLICATOR

[76] Inventor: Alton L. Fraleigh, 312 Rosalee, Rte. 3, Box B, Fort Myers, Fla. 33908

[21] Appl. No.: 910,233

[22] Filed: May 30, 1978

[51] Int. Cl.[3] ..... B05C 1/06; B05C 9/04

[52] U.S. Cl. ..... 401/9; 401/14; 401/148; 401/183; 401/272; 401/264; 101/379

[58] Field of Search ..... 101/379, 380; 401/9–11, 14, 15, 143, 146–148, 152, 183, 186, 205, 206, 272, 261, 268, 264; 118/3

[56] References Cited

U.S. PATENT DOCUMENTS

| | | | |
|---|---|---|---|
| 1,606,860 | 11/1926 | Winn | 401/148 |
| 2,979,757 | 4/1961 | Smith | 401/206 |
| 3,019,762 | 2/1962 | Hantz | 401/10 |
| 3,087,189 | 4/1963 | Scanlon | 401/11 |
| 3,175,242 | 3/1965 | Kamondy | 401/205 |
| 3,459,484 | 8/1969 | Abrams | 401/206 |
| 4,053,243 | 10/1977 | Levin | 401/205 |
| 4,117,566 | 10/1978 | Ward | 15/244 R |

*Primary Examiner*—William Pieprz
*Attorney, Agent, or Firm*—Alfred E. Wilson

[57] ABSTRACT

A compressible container such as a plastic squeeze bottle filled with paint and having an applicator nozzle with a spring loaded absorbant sponge unit which if desired may have short bristles is positioned in the outer open mouth of the nozzle, the mouth being shaped and sized to just receive an enlarged peripheral portion such as an attached washer of an object to be painted by the sponge when it is saturated with paint, while protecting the surrounding area from the paint.

1 Claim, 4 Drawing Figures

COMPRESSIBLE LIQUID CONTAINER AND APPLICATOR

BACKGROUND OF THE PRESENT INVENTION

The container and applicator device of the present invention is designed to apply paint to a screw head and enlarged flange or washer when used in combination as an attachment means or a very widely used type of screw which has a hexagonal head with an integrally formed round peripheral flange. This type of screw is widely used in mobile homes, motor homes and other structures. For example, the number of screws with peripheral flanges used in a single mobile home, number in the hundreds, being used to fasten sheet metal parts, counter tops, paneling, etc. They may be of the self tapping type or wood screw type.

These screws get tarnished and frequently rust or just get dirty, detracting from the appearance of the mobile home or other device. This is particularly true where they are used in the interior of the mobile home or the like, as around windows or sink area, or at the juncture of sheet metal or other panel members. It is a difficult and extremely tedious task to apply paint to these screws and flange devices without getting the paint on the surrounding areas of paneling or the like.

Therefore, one of the principal objects of the present invention is to provide a paint container and applicator device which is designed to apply paint to a screw head and surrounding flange while protecting surrounding areas from the paint.

Another object of the instant invention is to provide a squeeze bottle type of paint container with a round tubular spout containing a spring loaded sponge in its tip end to receive the paint from the container when the container is squeezed.

A further object of the invention is to size the mouth end, containing the sponge, to just receive the flange portion of the screw flange combination whereby a rotating movement of the container will cause the sponge to apply paint to the screw-flange combination while protecting the surrounding areas from the paint.

Yet another object of the invention is to provide a soft bristle like outer surface on the sponge.

DETAILED DESCRIPTION OF THE DRAWINGS

Figure 1:
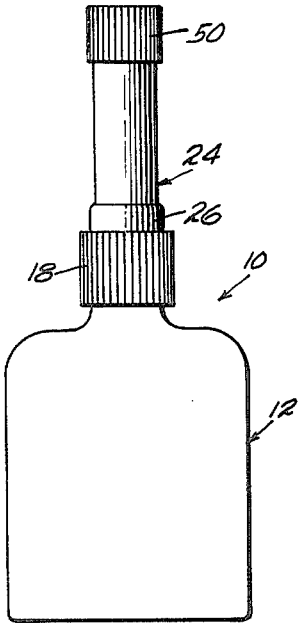
FIG. 1 is a side elevational view of the squeeze bottle and applicator nozzle with a closure cap in accordance with the present invention.
Figure 2:
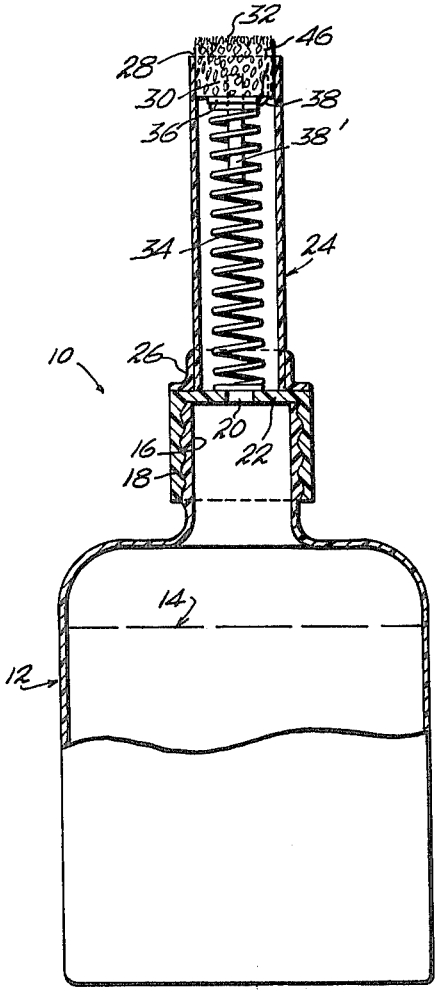
FIG. 2 is an enlarged view, similar to FIG. 1, with parts broken away to better illustrate the invention.

With reference to the drawings in which like reference characters designate like or corresponding parts throughout the various views and with particular reference to FIGS. 1 and 2, the compressible liquid container and applicator device is indicated generally at 10. The compressible liquid container is preferably in the form of a plastic squeeze bottle 12 which is filled with paint, indicated at 14, of any desired type and color. Squeeze bottle 12 has an externally threaded neck 16 to receive an interiorly threaded cap 18 having a central aperture 20 defining a peripheral top flange 22.

A round applicator tube 24 extends axially outwardly from the aperture 20 and is fixed to the outer peripheral portion of top flange 22 by means of an annular angle collar 26 which is adhesively secured between the inner end of applicator tube 24 and said top flange peripheral portion. Applicator tube 24 is provided with an extended open mouth 28 square cut perpendicularly to the axial length of the tube 24 for the reception of a sponge 30, as best illustrated in FIG. 2. Sponge 30 may if desired be provided with soft bristles 32 on its outer surface which may, for example, be formed by shredding the outer surface.

A compression spring 34 is disposed between the top flange 22 of the squeeze bottle 12 and the inner surface of sponge 30, If desired a washer 36 may be interposed between the spring 34 and the lower surface of the sponge 30. An end prong 38 of the spring 34 may project into the sponge 30 at a point spaced radially outwardly from the center of the sponge to insure its rotational movement when the bottle 12 and tube 24 are rotated when in use as hereinafter described, the opposite end of spring 34 projecting into an aperture in the flange 22 outwardly from the aperture 20 if desired. A tube 38' is carried in the sponge 30 and projects into the coil of the spring 34 to direct paint to the sponge 30.

Figure 3:
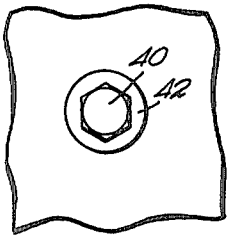
FIG. 3 is a view of a typical hex-headed screw and flange of a type to be painted by the applicator of the present invention.

FIG. 3 illustrates a typical type of hex-headed screw 40 and flange 42, attached through a surface to be painted by the device of the present invention.

Figure 4:
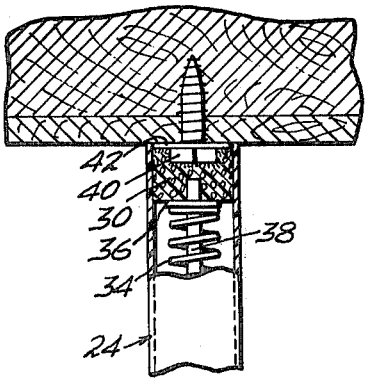
FIG. 4 is a fragmentary sectional view of the end, applicator portion of the device, illustrating its use in applying paint to a screw of the type of FIG. 3.

As illustrated in FIG. 2, the sponge 30 normally projects somewhat beyond the open mouth 28 as at 46 and in use as shown in FIG. 4, the open mouth 28, which is sized to just receive the flange 42, is positioned over the screw 40 and flange 42 depressing the compression spring 34. The compression forces of spring 34 squeeze the sponge, when saturated with paint, to some extent to cooperate with a normally applied rotary movement to the bottle and applicator tube to apply paint from the sponge to the exposed face of the flange and the screw head while protecting the surrounding surfaces from being smeared with paint.

As seen in FIG. 1, a closure cap 50 which may be of the press or snap type is provided for the open mouth end of applicator tube 28 when not in use. The bottle 12 is shaken prior to usage, to mix paint, preferably with the cap 50 on the tube 38 to prevent accidents. When ready for use, remove cap 50 and squeeze bottle 12 to bring paint to surface of applicator 30 ready for use.

I claim:

1. A liquid container and applicator to apply paint in the container to the exposed head of a screw and the outer surface of an annular flange surrounding the head when the screw is fixed in place, while protecting the areas surrounding the flange from the paint comprising, a plastic squeeze bottle having an externally screw threaded neck portion, an internally threaded cap for engagement on said neck portion and providing a central hole in a top wall thereof, defining a top peripheral flange, a round dispenser tube, and means to fix said tube to an outer portion of said peripheral flange in an upwardly extending relation thereto, said tube having an open mouth portion square cut perpendicularly to the axial length of the tube and with an inner diameter to just receive the flange surrounding the screw head, an absorbent sponge sized and shaped to fit in said open mouth portion, a compression spring, disposed in said dispenser tube between an inner portion of said peripheral flange and said sponge, said compression spring being proportioned in an unstressed relation to position a predetermined length of said sponge outwardly of said open mouth, and wherein one of the terminal ends of said compression spring, formed as a prong extends into said sponge to induce rotational motion of said sponge upon compression of said spring during application of paint to a screw and flange.

* * * * *